United States Patent [19]

Griesmer

[11] 3,960,556

[45] June 1, 1976

[54] CONSTANT CURRENT TONER TRANSFER

[75] Inventor: Jerome J. Griesmer, Mentor, Ohio

[73] Assignee: Addressograph Multigraph Corporation, Cleveland, Ohio

[22] Filed: Mar. 1, 1973

[21] Appl. No.: 336,993

[52] U.S. Cl. ..... 96/1.4; 250/326
[51] Int. Cl.[2] ..... G03G 13/14
[58] Field of Search ..... 96/1 R, 1.4; 250/326

[56] References Cited

UNITED STATES PATENTS

| | | | |
|---|---|---|---|
| 2,573,881 | 11/1951 | Walkup | 96/1.4 |
| 2,576,047 | 11/1951 | Schaffert | 96/1.4 |
| 2,892,708 | 6/1959 | Walkup | 96/1.4 |
| 3,062,956 | 11/1962 | Codichini | 250/326 |
| 3,318,698 | 5/1967 | Schwertz | 96/1.4 |
| 3,335,273 | 8/1967 | Walkup | 250/326 |
| 3,615,398 | 10/1971 | Caldwell | 96/1.4 |
| 3,675,011 | 7/1972 | Silverberg | 250/326 |
| 3,706,553 | 12/1972 | Menz | 96/1.4 |
| 3,781,105 | 12/1973 | Meagher | 117/17.5 |

*Primary Examiner*—David Klein
*Assistant Examiner*—John L. Goodrow
*Attorney, Agent, or Firm*—Ray S. Pyle

[57] ABSTRACT

In a photoconductive image processing system, consistent copy quality is possible if the charge necessary for the transfer of a toner image is produced by a source of substantially constant current. Changes in transfer material or humidity will not affect the current and thus the charge delivered. As a result, readjustment of the charge source is obviated.

2 Claims, 1 Drawing Figure

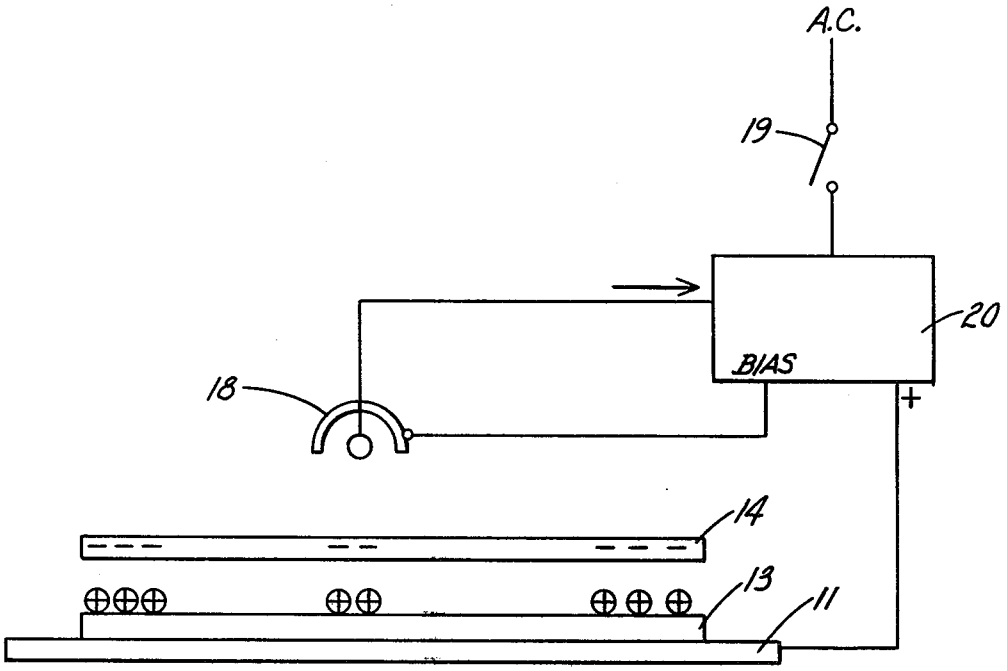
A.C.
19
20
BIAS
+
18
14
13
11

CONSTANT CURRENT TONER TRANSFER

BACKGROUND OF THE INVENTION

This invention relates in general to electrostatic copying systems, and in particular, to an improvement in the transferring of a toner pattern produced by an electrostatic image.

When a toner pattern produced by an electrostatic image is to be transferred from one surface to another, a charge is delivered to the surface to which the image is to be transferred.

This charge, being of an opposite polarity as compared to the toner charge, causes the toner particles to be attracted to the desired surface.

In the prior art, the charge delivered is in the form of an electrical potential established between the surface of the transfer member and the surface bearing the toner image. The efficiency of the transfer is directly related to the value of the electrical potential. However, there is a maximum value for the potential above which breakdown of the transfer surface may occur as a result of the transfer member acting as a dielectric for a "capacitor"in which the transfer device and the photoconductive backing member are the plates. At breakdown the dielectric no longer isolates the plates but allows a disruptive discharge to occur. This disruptive discharge between the image surface and the transfer surface results in at least partial destruction of the toner image. The maximum value depends on the transfer material and a number of environmental factors. In order to receive consistent copy quality, the electrical potential should be maintained at a uniform value.

The charge may be delivered to the transfer surface through the use of any one of a number of existing methods. One such method is a roller composed of conductive material supplied with a potential and positioned across the transfer surface so that it may be rolled across while in pressure applying contact with the surface of the transfer member opposite the imaged member.

Another such method is a corona discharge device with an electrode supplied with a potential and positioned to move with respect to the transfer member depositing a charge on the surface of the transfer member opposite the toner image. Still other methods are readily known in the prior art.

The value of the electrical potential applied to the transfer device resulting in a nondistorted transfer has been found to depend on the material of which the transfer surface is made and, more critically, on the relative humidity of the surroundings. Therefore, when a change occurs in any of the variables, the potential used in that transfer must be adjusted.

While readjusting the potential after changes in the transfer material and humidity, the current at which the transfer occurs was discovered as remaining constant regardless of the adjustment in potential.

SUMMARY OF THE INVENTION

It is therefore an object of this invention to improve the transferring of a developed toner image in an electrostatic printing device.

Another object of this invention is to eliminate frequent adjustments of the power supply producing the source of charge used in transferring an electrostatic image.

DESCRIPTION OF THE DRAWING

The drawing represents a diagrammatic illustration of one embodiment of the invention.

DESCRIPTION OF THE PREFERRED EMBODIMENT

In the embodiment shown in the drawing a backing member 11, generally of a conductive material, supports the toner developed image surface of an original support 13 shown with positively charged toner. Support 13 may be a paper sheet, a drum or belt coated with, or intrinsically of, photo-conductive characteristic. A transfer support 14 is shown with a corresponding negative image. The method used to produce the charge to transfer the image in this case is a corona discharge device 18. The switch 19 controlled by an unillustrated portion of the printing system causes the constant current power supply 20 to activate the corona discharge device at the appropriate times. The remainder of the circuit is completed by connecting the backing member 11 and the shield of the corona discharge device 18 to the appropriate returns on the power supply. The original toner image on the surface of support 13 is produced by any of the methods known in the art, i.e., charging a photoconductive surface, dissipating this charge selectively through exposure and developing by applying charged toner particles. The pluses on the surface of support 13 and correspondingly the negatives on the transfer support 14 are only illustrative of a charge on these surfaces and are not meant to limit the scope of this invention. The arrow adjacent to power supply 20 is present to indicate the direction of current flow in this embodiment only.

When the surface of transfer support 14 is brought into contact with, or near, the developed toner image surface of support 13, the toner image is transferred by activating the source of charge, in this case a corona discharge device. This is a result of the charge on the transfer support surface adjacent to the toner image attracting charged toner particles of opposite polarity on the toner image surface of support 13.

Charge as a function of a moving surface is defined by the formula:

$$q = \frac{Q}{A} = \frac{I}{LS}$$

where $q$ is the charge density, $Q$ is the charge, $A$ is the surface area, $I$ is the current, $L$ is the active length of the corona discharge device 18 and $S$ is the relative speed at which the surface is moving. In this case, where a toner developed image is to be transferred, the surface is the surface of the transfer member. Since the length of the corona discharge device and the speed of the surface are constant the result is a transfer charge density which is directly proportional to the current delivered.

When a voltage source is used to deliver the transfer charge, a basic electrical expression must be substituted for the current. The transfer charge density then becomes directly proportional to the voltage delivered, but inversely proportional to the transfer impedance:

$$I = \frac{V}{Z} \text{ and } q = \frac{V}{Z\,LS}$$

where $Z$ is the combined impedance from both resistance and capacitance effects and $I$ is the transfer current.

Thus a change in resistance, which could be the result of a difference in transfer material or an environmental change, effects the charge delivered to the transfer support surface in a system where the voltage is constant. However, by producing the charge through the use of a constant current source, changes in resistance will have no effect on the charge delivered and thus the transfer quality.

Notice should be taken that copy consistency will change with transfer current maintained constant when the current value used to deposit the toner on the latent image is allowed to vary. The current value used to deposit toner depends on a particular developer in a particular copy system. Once the initial set-up of a copy system has been completed the current value to deposit toner should remain constant for a given machine and therefore not offset the results.

What is claimed is:

1. The method of electrostatic printing by transferring an image of electrically charged particles between an original support and a transfer support, comprising:

developing a latent image on a surface of said original support by means of toner particles;

bringing a surface of said transfer support into virtual contact with the developed image; and applying a source of charge migration to all areas of said surface of the transfer support by bringing said surface to an electric potential resulting in a substantially uniform current density value, whereby the developed image on said surface of the original support is caused to be transferred to said surface of the transfer support.

2. In the method of claim 1, the source of charge migration being a corona discharge device.

* * * * *